US007377515B2

(12) United States Patent
Barker

(10) Patent No.: US 7,377,515 B2
(45) Date of Patent: May 27, 2008

(54) APPARATUS FOR CONVERTING A TABLE INTO A CARD TABLE

(76) Inventor: Steven Chandler Barker, 130 S. Front St., Memphis, TN (US) 38103

( * ) Notice: Subject to any disclaimer, the term of this patent is extended or adjusted under 35 U.S.C. 154(b) by 176 days.

(21) Appl. No.: 11/161,454

(22) Filed: Aug. 3, 2005

(65) Prior Publication Data

US 2007/0029731 A1 Feb. 8, 2007

(51) Int. Cl.
*A63D 13/00* (2006.01)
*A47B 13/08* (2006.01)

(52) U.S. Cl. ..... 273/309; 108/11; 108/13; 108/27; 108/158.13

(58) Field of Classification Search ..... 273/309; 428/99; 108/11, 13, 27, 90, 153.1, 157.1, 108/157.18, 158.13
See application file for complete search history.

(56) References Cited

U.S. PATENT DOCUMENTS

| | | | | | |
|---|---|---|---|---|---|
| 940,283 | A | | 11/1909 | Samuel | 52/782.21 |
| 1,219,790 | A | * | 3/1917 | Taylor | 108/90 |
| 1,684,173 | A | | 9/1928 | Diamond et al. | 108/90 |
| 2,555,547 | A | | 6/1951 | Kelleghan | 108/97 |
| 2,634,183 | A | * | 4/1953 | Derman et al. | 108/90 |
| 2,934,386 | A | | 4/1960 | Shore | 108/35 |
| 3,001,843 | A | | 9/1961 | Davis | 108/62 |
| 3,049,387 | A | | 8/1962 | Schlegel | 108/166 |
| 3,715,122 | A | | 2/1973 | Brown | 273/309 |
| 3,785,419 | A | | 1/1974 | Sherlock | 108/90 |
| 4,041,880 | A | | 8/1977 | Schankman | 108/175 |
| 4,158,905 | A | | 6/1979 | O'Leary | 24/530 |
| 4,170,181 | A | | 10/1979 | Glasgow | 108/28 |
| 4,336,936 | A | | 6/1982 | Young | 473/15 |
| 4,627,363 | A | * | 12/1986 | Jones | 108/90 |
| 5,908,681 | A | | 6/1999 | Foster | 428/99 |
| 6,523,486 | B1 | * | 2/2003 | Plitt et al. | 108/27 |
| 6,708,941 | B1 | * | 3/2004 | Bowen et al. | 248/345.1 |

* cited by examiner

*Primary Examiner*—William M. Pierce

(57) ABSTRACT

An apparatus that is used to convert a surface of a table into a card table, that can later be removed, stowed and easily transported. In its preferred embodiment, the device would be comprised of four major components: a thin flat piece of padding; a piece of cloth with a constricting perimeter, a long, soft, flexible border; and a strap with a joining mechanism. The device would be installed onto a table by laying the piece of padding flat on a table surface; covering the padding with the cloth; wrapping the border around the common edges of the cloth, padding and table; and securing the padding, cloth and border in place around the perimeter of a table surface edge through tension afforded by the strap, with the ends of the strap being connected by the joining mechanism.

5 Claims, 3 Drawing Sheets

Section B - B

APPARATUS FOR CONVERTING A TABLE INTO A CARD TABLE

BACKGROUND OF THE INVENTION

Card games are a popular form of entertainment whether they are played in the home or in public card rooms and casinos. Typically, card games are played on a table or other type of suitable surface. In general, the attributes of the tables, mainly their surfaces and edges, are important features in the suitability of the table to playing card games. The types of tables used in public card rooms and casinos have evolved into being superior pieces of equipment for the purposes of playing card games and posses key attributes. Tables such as kitchen tables, however, usually lack these key attributes.

Casino card tables posses four main attributes that make them ideal surfaces for playing card games. These attributes are: (1) a playing surface that is (a) a fabric texture, and (b) padded; and (2) a perimeter rail that is (a) elevated above the playing surface, and (b) soft. These four attributes each make a unique and vital contribution to enjoyment of the game. A fabric texture covering the playing surface provides the optimal level of friction to allow cards to slide freely along the playing surface while at the same time slowing their velocity so they eventually come to rest without outside intervention. The padding below the fabric covering dampens impact when solid articles of the game are placed or thrown into the center of the table, and also reduces noise. The elevated perimeter rail serves as a boundary around the playing surface that helps to contain the articles of the card game and prevent them from falling on the floor, and in a like fashion it prevents articles from being wrongfully introduced to the card game and thus helps to prevent cheating. The elevation of the perimeter rail is designed to position players forearms and hands in an optimal position for the retrieval, and manipulation of cards and other articles of the game. The softness of the perimeter rail makes it a comfortable place to rest your arms and hands. The combined benefit of these attributes is that they each contribute to making the mechanics of distributing and retrieving cards and other articles of the game easier and more efficient, and add to the comfort and enjoyment of the game.

There are two specific areas of need that this invention proposes to address. First, the home card player has a need for a table that can possess the superior playing attributes of a casino card table, while also being temporary, inexpensive and easy to stow. Second, the casino or public card room has a need due to the increasing popularity of tournament poker. The nature of tournament poker is that an ever increasing and often unpredictable number of people may show up for a tournament. The casino then needs to have a means of readily increasing the number of tables they can deploy on short notice, and these tables need to posses the four key attributes described above.

Prior art does exist in the field of this invention, but none of the examples of that art can solve each and every problem that are solved by the scope of this invention. Casino poker tables are widely known and readily available and they contain the four attributes outlined above as vital to the enjoyment of a card game, but they are a permanent fixture. They are constructed by placing a piece of plywood surface on top of a leg or base structure. The plywood surface is covered with a sheet of foam rubber and a sheet of fabric which is stapled in place. The rail is an assembly comprised of a rigid, one-piece wooden frame that is the size of the entire perimeter of the plywood playing surface. The rail has thick foam which is covered by a thin vinyl or leather sheet that is wrapped around the rail and stapled in place. The rail assembly is placed on top of the table. The standard casino card table can not be disassembled and stored very easily, and they are costly.

Some inventions have been created to solve the problem of a temporary card playing surface. These inventions accomplish this by way of a folding table design that is slightly compactable, but can still be quite large, heavy and hard to transport or stow. These designs also lack one or more of the four key attributes, previously stated above, that have become state of the art for permanent casino card table: a cloth-covered playing surface, padding below the cloth cover, an elevated perimeter rail and a soft edge border. In addition, many of these types of inventions are a completely separate and additional piece of furniture and do not take advantage of the usefulness afforded a table that a person may already possess.

BRIEF SUMMARY OF THE INVENTION

It is the object of this invention to provide a means of converting a top of a table, into a card table that will contain important attributes that contribute to the improved enjoyment and function of the game. In addition, this invention seeks to accomplish this means in a way that allows for easy installation, removal, storage and transportation, thus making the apparatus a non-permanent fixture and a temporary improvement to a table surface.

This invention consists of four main components: a cloth surface covering, a thin sub-cover padding, a flexible perimeter rail and a fastening strap. Each of these components contribute to satisfying the requirements for the key attributes that have been established by the state of the art in casino card tables as being essential to the efficient operation and enjoyment of the card game. Accordingly, The cloth surface covering provides a playing surface with the ideal friction level for playing card games. The thin sub-cover padding provides the shock-absorption and damping needed below the fabric covering of the playing surface. The flexible perimeter rail is raised above the playing surface to contain the articles of the card game within its edges and to position the players hands and forearms in an optimal position for manipulation of the cards and other articles of the card game. The flexible perimeter rail also serves as a comfortable resting surface for players to lean on. The fastening strap joins the flexible perimeter rail securely around the circumference of the table edge and holds it along with the cloth surface cover and the sub-cover padding in place through annular tension.

Each of the components being of soft flexible construction, the apparatus is lightweight and can be compacted. The simplicity with which the apparatus can be installed or removed from a table allows it to be readily deployed without difficulty. This invention offers a solution for the need of the home card game player to have a card playing surface that possesses the key attributes of a casino card table, while at the same time being a non-permanent fixture.

This invention offers a solution for the need of a casino or public card room by allowing them to supplement their tables that are permanent fixtures. Auxiliary tables can be fabricated from plywood with an simple leg structure. This invention would then provide all of the additional components to complete the table playing surface and perimeter. This would allow the casino to have a number of tables available in reserve. The tables are able to be stored more easily than standard poker tables due to the ease with which the invention can be folded and compacted. Such an auxiliary table thus can be fabricated easily, quickly and with less cost than a casino card table that is a permanent fixture.

DETAILED DESCRIPTION OF THE INVENTION

Figure 1:
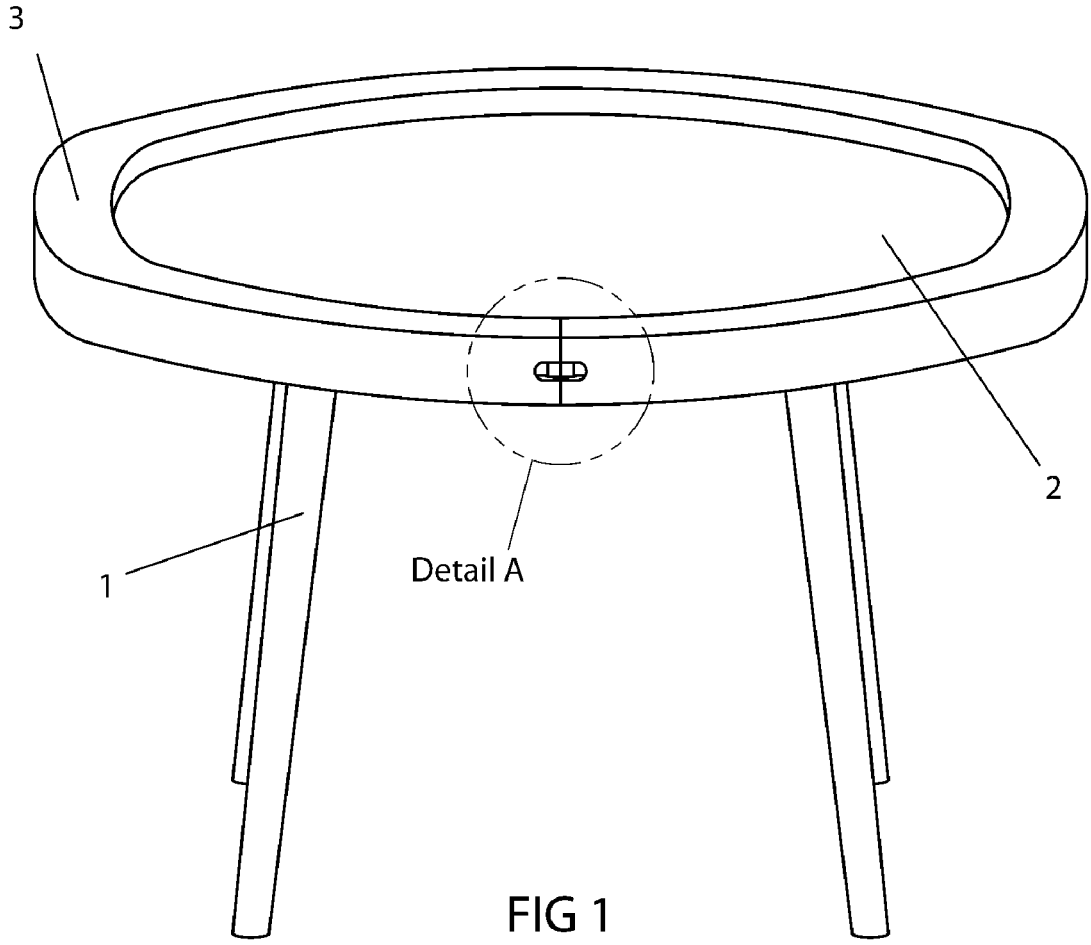
FIG. 1 (Sheet 1-3) Projection view of apparatus installed on a table

The novel features of my invention will be apparent from the following description taken in connection with the drawings:

The apparatus is shown in FIG. 1 as it would appear when it is installed on a surface of a table 1. Two of the main components will be readily visible in FIG. 1. The first component is the surface cover 2. The surface cover 2 is a thin, supple sheet which covers an underlying table 1 and creates the texture of the playing surface. In its preferred embodiment it is formed of cloth. The surface cover 2 is made by cutting it to a size slightly larger in area than the surface of a table 1 it is to cover.

The second component of the apparatus which is visible in FIG. 1 is the perimeter rail 3. The perimeter rail 3 is a soft flexible border of consistent profile. The perimeter rail 3 secures the other components of the apparatus to the table at the edge and provides padding. In its preferred embodiment, it is an elastomeric foam rubber material made by extruded method or the like. The perimeter rail 3 is cut to a length to correspond with the circumference of a table edge. The perimeter rail 3 can be shorter than the circumference of a table edge in the case where it is not desirable to have the perimeter rail 3 cover all of a table 1 edge. This may be the case when the apparatus is used as a replacement for a casino card table, as allowance is required for the dealer to sit as close as possible to the playing surface and this usually means there is no padded perimeter rail in front of their seating position.

Figure 2:
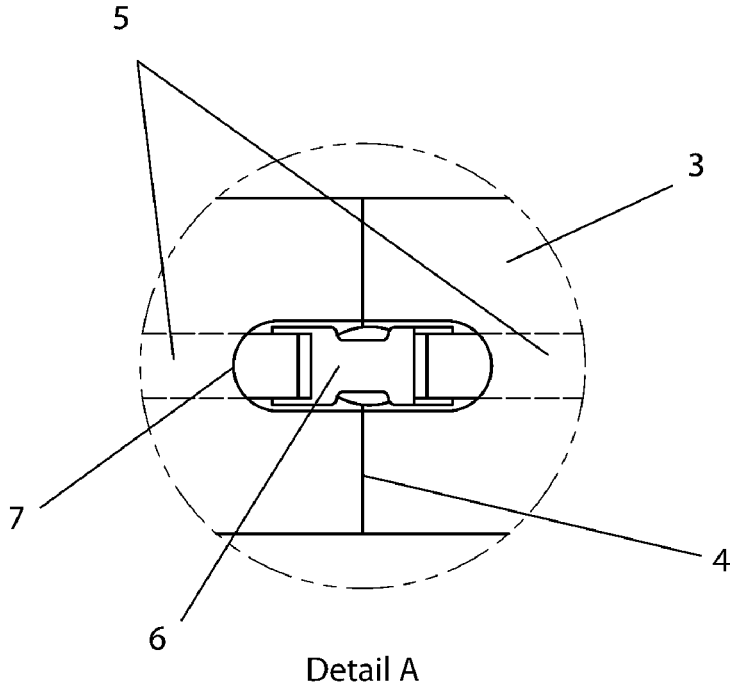
FIG. 2 (Sheet 1-3) Detail A—view of how strap secures the apparatus to the table FIG. 3 (Sheet 2-3) Top view of apparatus showing layers of each component FIG. 4 (Sheet 2-3) Section B-B—view showing each component along table edge FIG. 5 (Sheet 3-3) Exploded view

With the apparatus installed as shown in FIG. 1, the perimeter rail 3 completely surrounds the edge of a table 1. Referenced in FIG. 1 is Detail A which is a view of how the two opposite ends of the perimeter rail 3 are joined together to form a seam 4. Detail A can be seen in FIG. 2. The perimeter rail 3 is held in place by annular tension around the circumference of an edge of a table 1 provided by fastening strap 5. The fastening strap 5 is joined together at the ends by the joining mechanism 6. The fastening strap joining mechanism 6 can be a buckle, clasp, clip, latch, knot or other secure fastening means that can be repeatedly engaged and disengaged, and attaches to both ends of the fastening strap 5. Access to the joining mechanism 6 is possible through a cutout area 7 of the perimeter rail 3 that gives enough room to manipulate the joining mechanism 6 during engaging and disengaging said mechanism. The cutout area 7 is visible in FIG. 2.

The fastening strap 5 is not visible in FIG. 1 because in the preferred embodiment it runs through an opening that runs the entire length of the perimeter rail 3. The fastening strap 5 can be a belt, webbing, string, rope, band, chord, or other long, thin flexible device of standard construction that is capable of surrounding the circumference of the perimeter rail 3 and being tensioned, whether it is outside of the edge of the perimeter rail or though a conduit, set of loops, or hole within the body of or adjacent to or attaching to the perimeter rail 3. It should be understood that the fastening strap can be set or adjusted to a length that will be the appropriate length to surround the surface cover 2, sub-cover padding 8 and table 1 edge and to hold the perimeter rail 3 in place.

Figure 3:
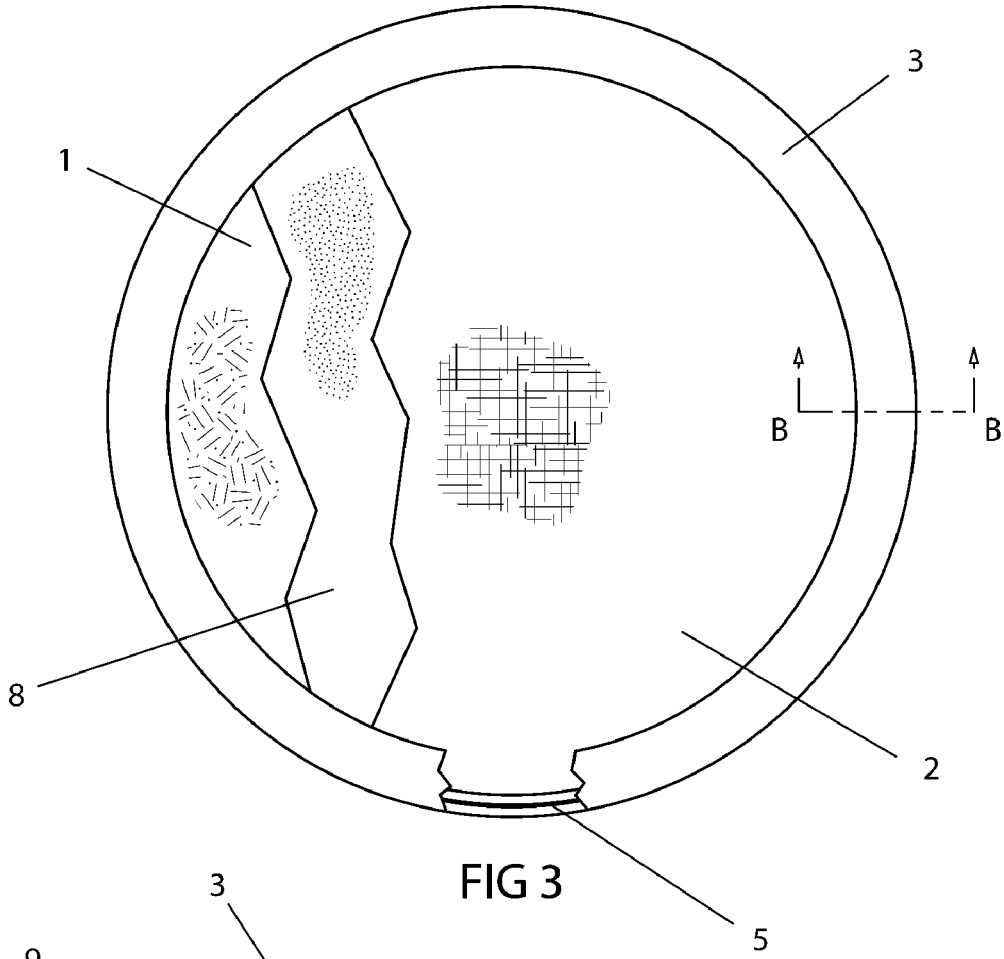

A top view of the apparatus as assembled on a table 1 is shown in FIG. 3. The surface cover 2 is cut away to reveal the sub-cover padding 8. In its preferred embodiment the sub-cover padding 8 is a thin sheet approximately ¼ inch thick of elastomeric foam. It is formed by cutting it to the shape of a table 1 surface. The sub-cover padding 8 is also shown cut-away in FIG. 3 to reveal that below it is the surface of a table 1. Thus, two components of the apparatus, the surface cover 2 and the sub-cover padding 8 are essentially layered on top of, and cover the entire surface of a table 1. Also in FIG. 3, part of the perimeter rail 3 is cut away to reveal the fastening strap 5 that is enclosed within the perimeter rail 3 and runs around the circumference of the perimeter of a table 1 edge.

Figure 4:
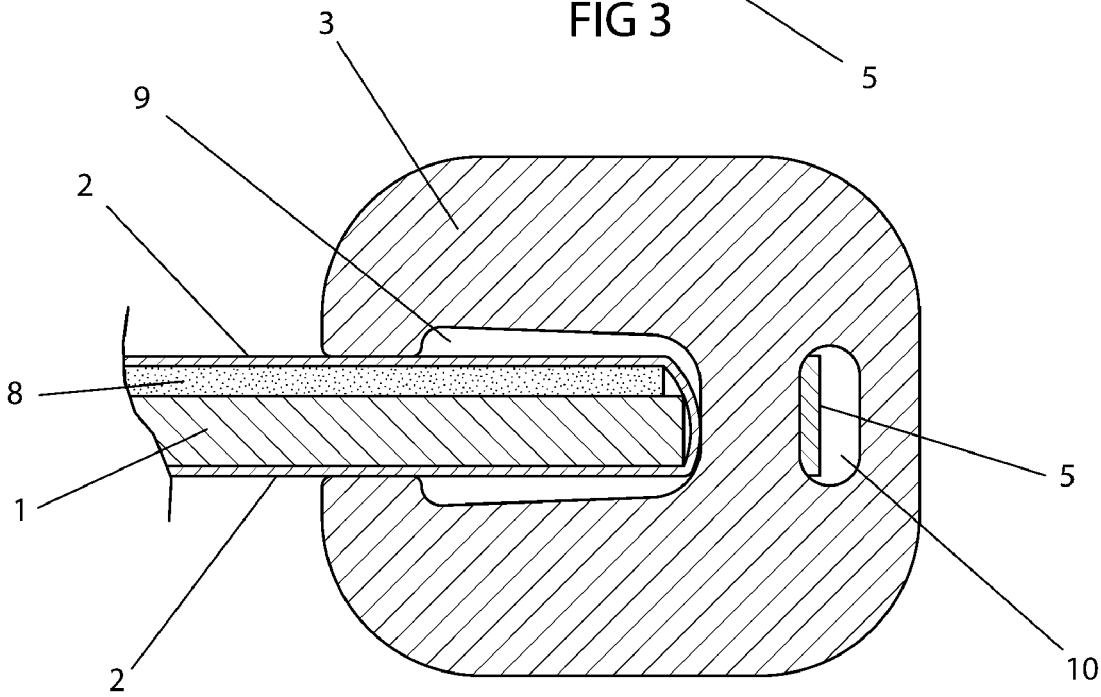

A section view of the perimeter rail 3 can be seen as Section B-B in FIG. 4 and it reveals that the perimeter rail 3 has three important features that can be seen when it is viewed from the profile. First, the middle of the perimeter rail 3 is cutout to give it the shape of 'C' and thus forming a peripheral channel 9 when the perimeter rail 3 is formed around a table edge. This channel 9 allows the perimeter rail 3 to accommodate the combined thickness of a table 1, the surface cover 2 and the sub-cover padding 8. Second, in the preferred embodiment there is a fully-enclosed hole 10 in the profile that runs the entire length of the perimeter rail 3 like a tunnel. This hole 10 or conduit accommodates the fastening strap 5. Third, the exterior edges of the perimeter rail 3 are contoured to provide a soft comfortable exterior.

The perimeter rail 3 differs from other prior art that secures a cloth table covering to the table because it is a continuous form that surrounds the entire edge of a whole table.

The perimeter rail 3 differs from other prior art that provides padding because it does not guard a hard edge from abrupt, accidental contact. Instead, it provides cushion and comfort for enduring, intended contact.

Above and beyond said distinctions from existing prior art, the perimeter rail serves two additional purposes. First, the perimeter rail 2 extends vertically above the horizontal plane of the playing surface to provide a wan of containment for articles of the card game that are meant to be kept within the boundary of the playing surface. Second, the perimeter rail 3 positions the players' hands and forearms in a comfortable position for handling and manipulating cards and other articles of the game. Also, the perimeter rail 3 is intended to be removed when the apparatus is removed from a table. The usefulness of the perimeter rail 3 is limited to the duration that the apparatus is used to improve the attributes of a table fix the purpose of playing cards.

Figure 5:
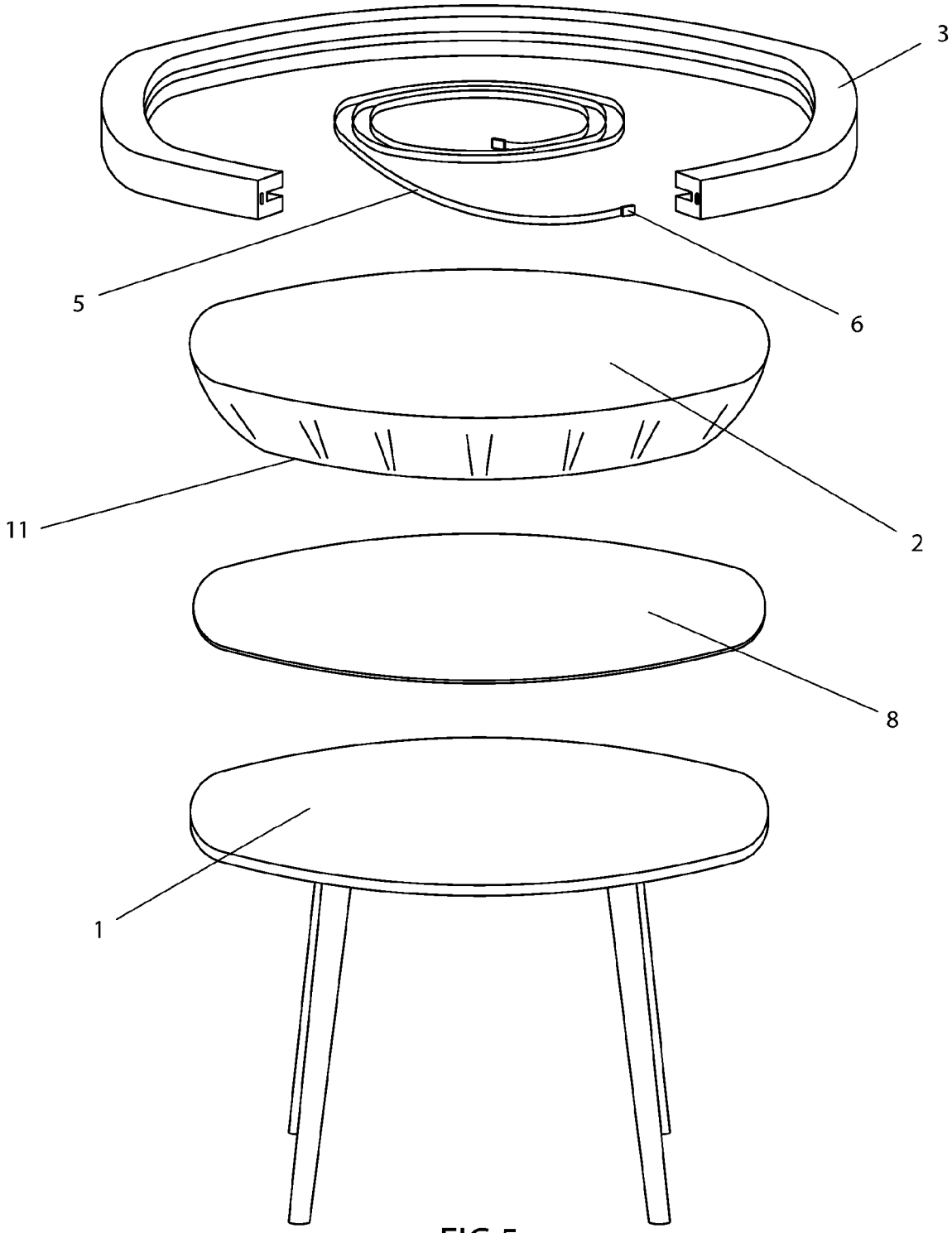

The exploded view of FIG. 5 illustrates how the components of the apparatus are assembled. Assembling the apparatus onto a table 1 can be accomplished in four steps. First, the sub-cover padding 8 is placed on a table 1. Second, the surface cover 2 is placed over the sub-cover padding 8 and a top of table 1. The surface cover 2 may have a constricting perimeter 11 which would allow any slack in the surface cover 2 to be taken up, thus enabling the surface cover 2 to conform to the shape of an underlying table 1. The constricting perimeter 11 expanded to surround and engulf the top of a table 1, and then allowed to constrict or tighten below the plane of the bottom of the surface of a table 1. In its preferred embodiment, the constricting perimeter would be elastic or a draw-string. Third, the perimeter rail 3 is wrapped along the edge circumference of a table 1, surface cover 2, and sub-cover padding 8 until its ends meet. At this point the fastening strap 5 is tightened and joined by the joining mechanism 6.

Having thus described in detail preferred embodiments of the present invention, it will be apparent to those skilled in the art that many physical changes may be made without altering the inventive concepts and principles. The present embodiments are therefore to be considered in all respects as illustrative and not restrictive, the scope of the invention being indicated by the appended claims.

What is claimed is:

1. A removable, flexible, compactable, lightweight device that changes a top of a table into a game surface resembling that of a casino card table consisting of:

a thin surface cover of flexible material with a perimeter that can be constricted by elastic or drawstring to cover a top of a table and provide a proper coefficient of friction for the game surface, a thin sub-cover padding to provide damping and cushioning to a top of a table that is positioned on top of a table surface and below the surface cover, a flexible perimeter rail to secure the surface cover and sub-cover padding, provide an arm rest, and create an elevated perimeter border, a tightening strap with a joining mechanism having means and function to hold the flexible perimeter in place in an annular fashion, that passes through a hole or slot in the flexible perimeter rail.

2. The device as recited in claim 1 where said perimeter rail has a cross-section profile with;

channel sized large enough to accommodate the thickness of: a top of a table, the cloth surface cover, and the sub-cover padding;

hole sized large enough to contain the tightening strap and forming an enclosure to guide the path for the tightening strap and anchoring its position that runs along the length of said perimeter rail.

3. The device as recited in claim 1 where said perimeter rail is:

of uniform profile, flexible, composed of a single material.

4. The device strap as recited in claim 1 where said tightening strap:

is non-permanent and removable, is accomplished by way of a belt, webbing, string, rope, band, chord, or other such similar device of standard composition, provides annular tension along the edge of the underlying table and brings each end of the perimeter rail around the circumference of the table surface and in close proximity to each other, forming the shape of said perimeter rail into a closed loop as defined by the edge of a table surface perimeter.

5. The device as recited in claim where an each end of the tightening strap secured to each other by a joining mechanism such as a buckle, clasp, snap, tie, clip or other such similar device of standard composition.

* * * * *